US009192973B1

(12) United States Patent
VanDanacker et al.

(10) Patent No.: US 9,192,973 B1
(45) Date of Patent: Nov. 24, 2015

(54) DRAWING PROCESS FOR TITANIUM

(71) Applicant: Meier Tool and Engineering, Inc., Anoka, MN (US)

(72) Inventors: Tony VanDanacker, Blaine, MN (US); Mike Gehling, East Bethel, MN (US); Jordan Gaffaney, Ramsey, MN (US); Corey Klebs, Bethel, MN (US); Jason Diffley, Monticello, MN (US); Levi Olson, Otsego, MN (US); Scott Sportel, Crystal, MN (US)

(73) Assignee: Meier Tool & Engineering, Inc., Anoka, MN (US)

( * ) Notice: Subject to any disclaimer, the term of this patent is extended or adjusted under 35 U.S.C. 154(b) by 269 days.

(21) Appl. No.: 13/801,035

(22) Filed: Mar. 13, 2013

(51) Int. Cl.
*B21D 22/20* (2006.01)

(52) U.S. Cl.
CPC ..... *B21D 22/201* (2013.01)

(58) Field of Classification Search
CPC ..... B21D 37/18; B21D 22/201; B21C 43/14; B21C 9/00; B21C 9/02; B21C 23/32; B21C 43/00; B21C 43/02; B21J 3/00
See application file for complete search history.

(56) References Cited

U.S. PATENT DOCUMENTS

| | | | | |
|---|---|---|---|---|
| 2,588,234 | A | | 3/1952 | Henricks |
| 2,619,458 | A | | 11/1952 | McBride |
| 2,736,700 | A | | 2/1956 | Graham |
| 2,741,567 | A | | 4/1956 | Otto |
| 2,864,732 | A | | 12/1958 | Miller et al. |
| 2,934,480 | A | | 4/1960 | Slomin |
| 2,935,431 | A | | 5/1960 | Shaw et al. |
| 2,991,206 | A | | 7/1961 | Miller et al. |
| 3,269,943 | A | | 8/1966 | Armstrong et al. |
| 3,280,027 | A | | 10/1966 | Pierre et al. |
| 3,296,844 | A | | 1/1967 | Quinlan |
| 3,297,552 | A | | 1/1967 | Gisser et al. |
| 3,369,930 | A | * | 2/1968 | Wojtowicz ..... 428/341 |
| 3,481,762 | A | | 12/1969 | Streicher |
| 3,522,177 | A | | 7/1970 | Benz |
| 3,605,476 | A | | 9/1971 | Hinshaw |
| 3,934,441 | A | | 1/1976 | Hamilton et al. |
| 3,974,674 | A | | 8/1976 | Orozco et al. |
| 3,984,599 | A | | 10/1976 | Norton |
| 3,992,303 | A | | 11/1976 | Barker et al. |
| 4,281,528 | A | | 8/1981 | Spiegelberg et al. |
| 4,354,370 | A | | 10/1982 | Ullman, Jr. |
| 4,370,244 | A | | 1/1983 | Weinhold et al. |
| 4,412,440 | A | * | 11/1983 | Phalin et al. ..... 72/46 |
| 4,983,340 | A | | 1/1991 | Montgomery |
| 5,221,576 | A | | 6/1993 | Bosc et al. |

(Continued)

FOREIGN PATENT DOCUMENTS

| | | |
|---|---|---|
| EP | 0 007 793 | 2/1980 |
| EP | 0 412 788 A1 | 2/1991 |

(Continued)

*Primary Examiner* — Teresa M Ekiert
(74) *Attorney, Agent, or Firm* — Patterson Thuente Pedersen, P.A.

(57) ABSTRACT

A cold drawing process for forming titanium blanks into titanium pieces in which the titanium blank is pre-treated with a wet lubricant prior to drawing. The wet lubricant lubricates the interfaces of the titanium blank and the punch to substantially reduce galling and hardening of the surface of the titanium blank from the drawing process, thereby eliminating the need to anneal the formed titanium pieces prior to additional drawing, stamping, punching or other forming processes.

19 Claims, 4 Drawing Sheets

(56) References Cited

U.S. PATENT DOCUMENTS

| | | | |
|---|---|---|---|
| 5,340,463 | A | 8/1994 | Layre et al. |
| 5,498,351 | A | 3/1996 | Hefling |
| 6,027,145 | A | 2/2000 | Tsuru et al. |
| 6,034,041 | A | 3/2000 | Nittel et al. |
| 7,168,142 | B2 | 1/2007 | Nowaczyk |
| 7,414,012 | B2 | 8/2008 | Imai et al. |
| 7,462,582 | B2 | 12/2008 | Komiyama et al. |
| 7,879,772 | B2 | 2/2011 | Komiyama et al. |
| 2002/0019321 | A1 | 2/2002 | Balliett |
| 2003/0130137 | A1 | 7/2003 | Imai et al. |
| 2003/0130138 | A1 | 7/2003 | Imai et al. |
| 2003/0130139 | A1 | 7/2003 | Komiyama et al. |
| 2004/0156995 | A1 | 8/2004 | Komiyama et al. |
| 2008/0302454 | A1 | 12/2008 | Kajihara et al. |
| 2010/0011826 | A1 | 1/2010 | Buehler et al. |

FOREIGN PATENT DOCUMENTS

| | | | |
|---|---|---|---|
| EP | 0 459 909 | A1 | 12/1991 |
| EP | 0 900 130 | A1 | 3/1999 |
| EP | 1 319 702 | A1 | 6/2003 |
| EP | 1 319 703 | A1 | 6/2003 |
| EP | 1 454965 | A1 | 9/2004 |
| EP | 1 491 615 | A1 | 12/2004 |
| EP | 2 195 128 | A1 | 6/2010 |
| EP | 2 437 906 | A2 | 4/2012 |
| WO | WO 91/18962 | | 12/1991 |

* cited by examiner

DRAWING PROCESS FOR TITANIUM

FIELD OF THE INVENTION

The present invention is generally directed to a drawing process for forming titanium pieces. Specifically, the present invention is directed to a drawing process in which roughened titanium blanks are pre-treated with a wet lubricant to minimize galling of the titanium during drawing.

BACKGROUND OF THE INVENTION

Titanium and titanium alloys are often used in casings for implantable medical devices. The high strength to weight ratio of titanium provides a lightweight, yet structurally strong casing. Similarly, the corrosion resistant nature of titanium allows titanium casings to survive the corrosive fluids within the body. Titanium can undergo a passivation process to further improve the corrosion resistance of the titanium. An added advantage is that titanium is non-toxic and biocompatible reducing the likelihood that the patient will suffer complications from the implantation resulting from the casing itself. While titanium has many material characteristics that are advantageous for implantable medical devices, the material characteristics of titanium also make forming titanium into the appropriate shape difficult.

The high melting point of titanium makes melting or heating titanium for molding or hot forming titanium into the appropriate shapes impractical for high volume manufacturing. Accordingly, titanium casings are typically made in a cold drawing process where a generally planar blank is shaped into the appropriate cup shape by mechanically deforming a titanium blank. In the drawing process, a recessed die is positioned beneath the blank and a punch is pushed against the blank deforming the center portion of the blank into the shape defined by the recess of the die. The punch typically comprises a metal element that is hydraulically pressed with substantial force against the titanium blank. An inherent drawback of the drawing process is that the high pressure metal on metal contact between the titanium blank and the punch typically results in adhesive wear, or galling, of the surface of the drawn titanium piece. In particular, the deformed edge portions of the drawn titanium piece are particularly susceptible to galling. Galling can weaken the titanium pieces, providing an uneven titanium surface and form areas where corrosion can begin. The drawing process can also harden the titanium piece, making the deformed edge portions brittle and at risk for fracturing or tearing during subsequent drawing or punching processes. As a result, drawn titanium pieces are typically heated with an annealer to smooth the surface of the titanium pieces and soften the titanium prior to additional drawing, punching, or other forming of the titanium pieces.

During the annealing process, the titanium pieces must typically be heated to over 1600° F. to induce a material change in the titanium smoothing the galling and softening the titanium. The high annealing temperature for the titanium typically prevents a continuous annealing process as substantial time is required to heat the titanium pieces to the required temperature. Similarly, the high annealing temperature also requires a substantial cooling time in which the titanium pieces are cooled back to a safe handling temperature before being removed from the annealer. Accordingly, a batch annealing process, in which a plurality of drawn titanium pieces are drawn individually before being heated together as a batch, is frequently used to provide some efficiency to the annealing process. However, the batch process is time consuming and labor intensive requiring operators to manually load and unload a plurality of drawn pieces into and out of the annealer creating a substantial bottleneck in the production process.

Although titanium has numerous material characteristics that make it a superior material choice for many applications, the same material characteristics present numerous challenges for drawing and other forming processes. In particular, the substantial inefficiencies of conventional titanium drawing processes create a need for streamlining the process of producing titanium casings.

SUMMARY OF THE INVENTION

The present invention is generally directed to a cold drawing process for forming titanium blanks in which generally planar titanium blanks are pressed with a punch to form shaped titanium pieces. Specifically, the present invention is directed to a pre-treatment process in which a wet lubricant is applied to the blanks to lubricate the contacting surfaces of the titanium blank and the punch. The wet lubricant reduces galling and work hardening of the portions of the titanium blank deformed during the drawing process, thereby eliminating the need to anneal the formed titanium pieces prior to additional drawing, punching or other forming processes. Removing the annealing step removes a substantial bottleneck in the titanium forming process enabling a continuous or nearly continuous process in which each drawn titanium piece is immediately moved onto the next process step, substantially increasing the production rate of the formed titanium pieces.

In certain embodiments, the wet lubricant can comprise a blended graphite and mineral spirits lubricant. In certain embodiments, the graphite comprises between about fifteen and about thirty-five percent of the lubricant blend by weight. In other embodiments, the graphite comprises about twenty percent of the lubricant blend by weight. The graphite and mineral spirits composition can be applied to the titanium blank, wherein the mineral spirit component adheres the graphite component to the surface of the titanium blank to provide a solid lubricant coating on the titanium blank without chemically bonding the graphite to the titanium. During the drawing of the titanium blank, the mineral spirits maintain the graphite on the surface of the titanium blank such that the graphite acts as a solid lubricant for the contacting surfaces of the titanium blank and the punch. Unlike conventional lubricant oils that can be wiped off the surface by the punch during the drawing process, the viscosity of the mineral oil retains the graphite component on the titanium blank through the drawing process.

In certain embodiments, the graphite and mineral spirits composition can be stripped from the formed titanium pieces following drawing through a pressurized water wash process without the use of additional chemical solvents. In certain aspects, the pressurized water stream can be applied between 900 psi and 1100 psi. In other aspects, the applied water can be applied at about 1000 psi. This process is particularly advantageous with respect to many medical applications of titanium sheeting, such as titanium casings for implantable devices where any chemical residue from mineral spirits, graphite or chemical solvents can impact the health of the patient. Similarly, any residue on the titanium casings can also disrupt any subsequent passivation processes that the titanium may be subjected to prior to implantation, increasing the risk that the titanium will corrode after implantation.

In certain embodiments, the surface of the titanium blank can be roughened prior to the application of the wet lubricant.

The roughening of the titanium surface further improves the adhesion of the graphite component to the titanium surface without chemically bonding the graphite component to the titanium surface. The roughened surface better retains the wet lubricant during the drawing process as the punch is pressed against the titanium surface. In certain aspects, the titanium surface can have a roughness of between about 20 Ra to about 40 Ra. In other aspects, the titanium surface can have a roughness of between about 10 Ra to about 50 Ra. If the titanium surface is too smooth the lubricant can be wiped off the titanium surface during drawing. Conversely, if the titanium surface is too rough, the wet lubricant can be difficult to strip from the crevices formed in the roughened surface during the cleaning process resulting in pockets of the lubricant being retained on the titanium surface.

A method of forming titanium pieces from generally planar titanium blanks, according to an embodiment of the present invention, can comprise providing a first die defining a first recessed cavity and a first punch movable along a first linear path intersecting the first recessed cavity. According to certain embodiments, the first die can be movable along the first linear path, while the first punch remains fixed in position. The method can also comprises providing a generally planar titanium blank having at least one roughened face. The method can also comprise applying a wet lubricant to the roughened face of the titanium blank. The method can further comprise positioning the titanium blank on the first die such that a portion of the titanium blank is aligned with the first recessed cavity of the first die. Finally, the method can also comprise moving the first punch along the first linear path to engage the lubricated roughened face of the titanium blank and deform the aligned portion of the titanium blank into the first recessed cavity of the first die.

In certain embodiments, the method can further comprise providing a second die defining a second recessed cavity and a second punch movable along a second linear path intersecting the second recessed cavity, wherein the second recessed cavity is deeper than the first recessed cavity. According to certain embodiments, the second die can be movable along the second linear path, while the first punch remains fixed in position. The method can also comprise applying additional wet lubricant to the roughened face of the formed titanium piece to supplement or replace the wet lubricant on the titanium blank. In certain aspects, the amount of additional wet lubricant added can comprise about 40% of the original amount of wet lubricant added at the first drawn station. The method can further comprise positioning the formed titanium piece on the second die such that deformed portion of the titanium piece is received within the second recessed cavity of the second die. The method can also comprise moving the second punch along the second linear path to engage the lubricated roughened face of the titanium piece and further elongate the deformed portion of the titanium piece. The two stage lubricating and drawing approach reduces the likelihood that the titanium blank will fracture then if the entire drawing process was done in a single draw station.

A method of producing a titanium casing having a base portion and at least one wall portion angled relative to the base portion, can comprise providing a first die defining a first recessed cavity and a first punch movable along a first linear path intersecting the first recessed cavity. The method can also comprise providing a generally planar titanium blank having at least one roughened face. The method can also comprise applying a wet lubricant to the roughened face of the titanium blank. The method can further comprise positioning the titanium blank on the first die such that a portion of the titanium blank is aligned with the first recessed cavity of the first die. Finally, the method can also comprise moving the first punch along the first linear path to engage the lubricated roughened face of the titanium blank and press a planar base portion of the titanium blank into first recessed portion and deforming the titanium blank against the first die to form at least one wall portion angled relative to the base portion. The method can further comprise rinsing the formed titanium piece with a high pressure water stream to strip the wet lubricant from the formed titanium piece. Finally, the method can comprise a punching process in which the titanium blank is trimmed with a punching die to remove any excess portions of the formed titanium piece. In certain aspects, the method can also comprise a passivation process in which the titanium piece is treated to form an anti-corrosion layer on the titanium piece.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
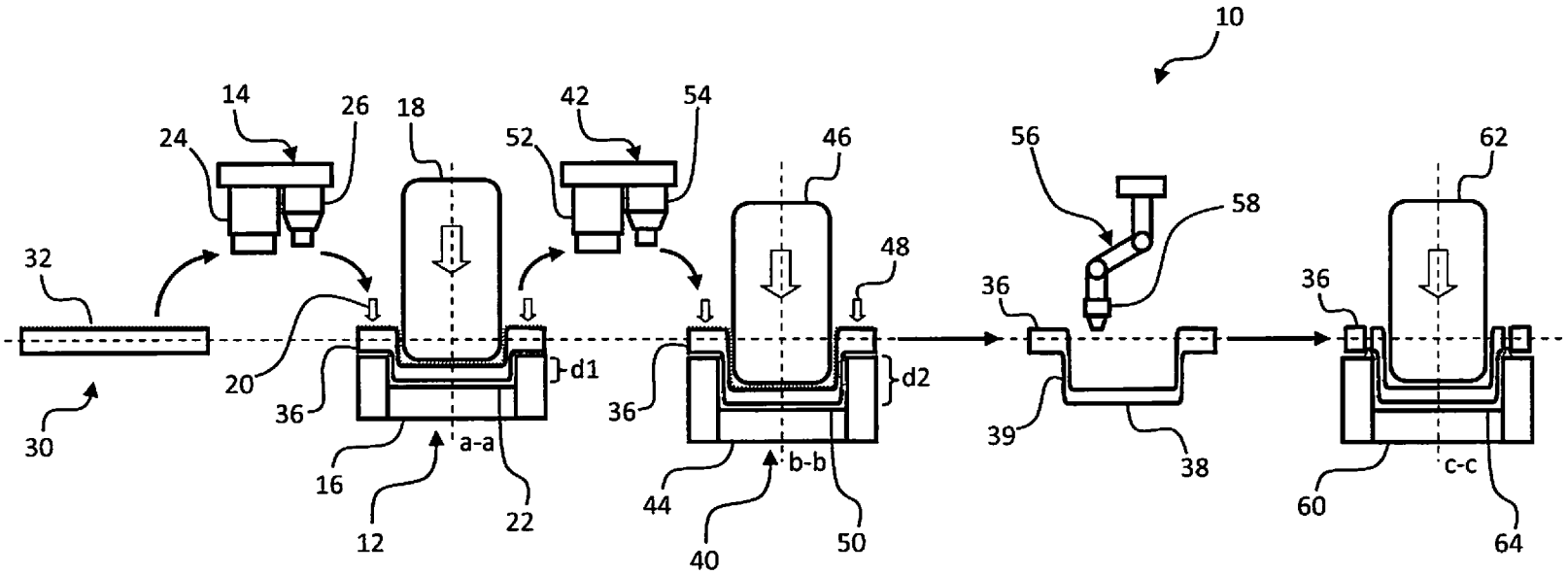
FIG. 1 is a schematic diagram of a system for forming a titanium blank into a formed titanium piece according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 3:
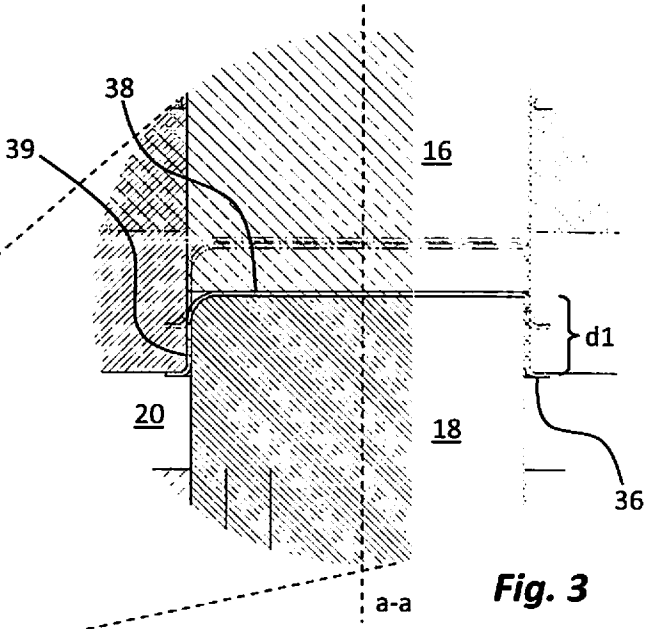
FIG. 3 is a detailed cross-sectional side view of the drawing station depicted in FIG. 2.
Figure 2:
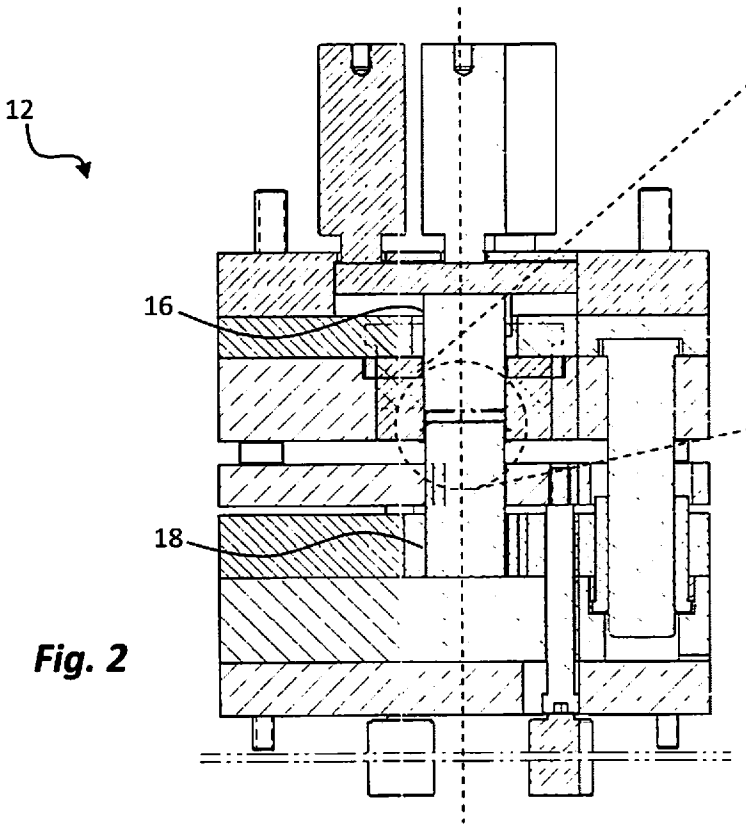
FIG. 2 is a cross-sectional side view of a drawing station, according to an embodiment of the present invention.

As depicted in FIGS. 1-3, a drawing system 10 for forming titanium blanks into formed titanium pieces, according to an embodiment of the present invention, generally comprises a first drawing station 12 and a first transfer assembly 14. For the purposes of this disclosure, a titanium blank refers to a generally planar titanium element that has not been drawn. Similarly, a titanium piece refers to a titanium element that has been drawn at least once. The first drawing assembly 12 comprises a first die 16 and a first punch 18 movable along a first linear axis a-a. In certain aspects, the first drawing assembly 12 further comprises a locking press 20 for engaging the edge portions of the titanium blank to secure the titanium blank to the first die 16. The first die 16 defines a first recess 22 corresponding to the intermediate or final shape of the formed titanium piece. In one aspect, the first recess 22 comprises a generally tubular shape having a generally horizontal bottom and vertical walls defining a first recess depth d1. In operation, the first linear path a-a is aligned with the first recess 22, such that moving the first punch 18 along the first linear axis a-a inserts a portion of the first punch 18 into the first recess 22.

The first transfer assembly 14 is adapted to pick up and position titanium blanks and comprises an engagement element 24 and a lubricant application element 26. The first transfer assembly 14 can be positioned on a robotic arm, movable assembly or other conventional system for moving the titanium blanks. The engagement element 24 comprises a suction element, a magnetic element or other convention means of releasably engaging the titanium blank to position the titanium blank. The lubricant application element 26 can comprise a spray assembly or other conventional system for depositing a quantity of wet lubricant on a titanium blank secured by the engagement element 24. In certain aspects, the lubricant application element 26 can be operated to apply the wet lubricant while the engagement element 24 is secured to the titanium blank or after the titanium blank is positioned for drawing. In certain aspects, the wet lubricant comprises a graphite component and a mineral spirits component. In various aspects, the graphite component can comprise fifteen to thirty-five weight percent of the lubricant. In other aspects, the graphite component can comprise about twenty-five weight percent of the lubricant. In other aspects, the ratio of graphite component to mineral spirits component is 1:3 by weight.

Figure 4:
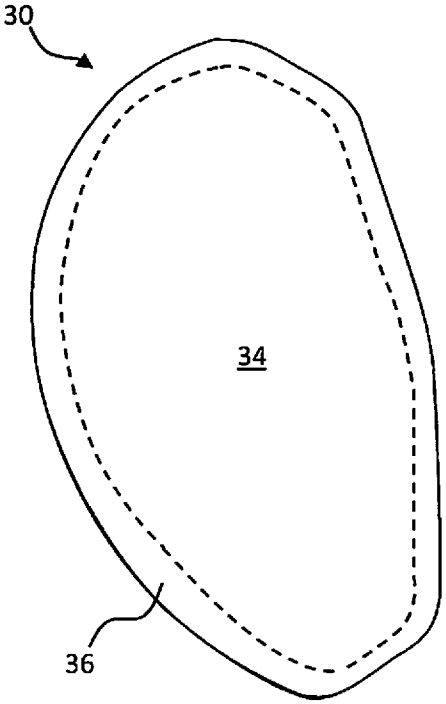
FIG. 4 is a perspective view of a titanium blank for use with the present invention.
Figure 6:
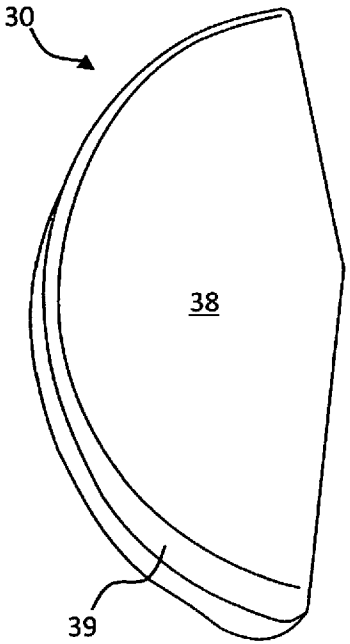
FIG. 6 is a perspective view of the titanium piece depicted in FIG. 5 after punching to remove excess titanium.
Figure 5:
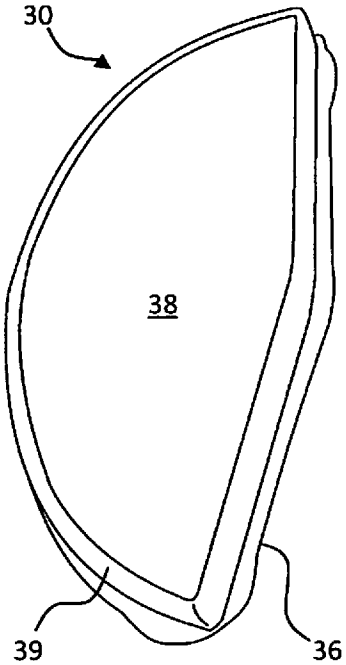
FIG. 5 is a perspective view of a formed titanium piece formed from the titanium blank depicted in FIG. 4 according to an embodiment of the present invention.

As shown in FIGS. 4-6, a titanium blank 30 for use with the drawing system 10 generally comprises a planar surface with at least two faces 32. The titanium blank 30 can comprise elemental titanium and titanium alloys. More particularly, the titanium blank 30 comprises grade 1 titanium. In certain aspects, the titanium blank 30 can comprise grade 23 titanium. In certain aspects, the titanium blank 30 comprises a formable center portion 34 surrounded by an edge portion 36. At least one of the faces 32 is roughened to a roughness of 10 Ra to 50 Ra. At least one of the faces 32 is roughened to a roughness of 20 Ra to 40 Ra. In certain aspect, the titanium blanks 30 can be punched from a titanium sheet.

In operation, the engagement element 24 of the first transfer assembly 14 engages a titanium blank 30 and maneuvers the titanium blank 30 onto the first die 16 such that the center portion 34 of the titanium blank 30 is aligned with the first recess 22. During positioning or after the titanium blank 30 is positioned on the first die 16, lubricant application element 26 is operated to apply a first quantity of wet lubricant onto the roughened face 32 of the titanium blank 30. In certain aspects, between about 3.0 and about 6.5 ml per sq in of wet lubricant is applied by the lubricant application element 26. In other aspects, about 4.3 ml per sq in of wet lubricant is applied by the lubricant application element 26. The titanium blank 30 is positioned on the first die 16 such that the lubricated roughened face 32 is positioned opposite the first recess 22. In certain aspects, the locking press 20 is closed to engage the edge portion 36 of the titanium blank 30 to the first die 16. The first punch 18 is moved along the first linear axis a-a and engaged to the lubricated roughened face 32. The first punch 18 applies a deforming force along the linear axis a-a against the lubricated roughened face 32 to deform the center portion 34 of the titanium blank 30 against the surfaces of the first die 16 defining the first recess 22. As depicted in FIGS. 5-6, in certain aspects, center portion 34 is deformed to define a horizontal base portion 38 and vertical wall portions 39 corresponding to the dimensions of the first recess 22. In certain aspects, the edge portion 36 retained within the locking press 20 remains unformed. The first punch 18 can then be reversed along the linear axis a-a and the formed titanium piece can then be removed.

As depicted in FIGS. 1-3, in certain embodiments, the drawing system 10 further comprises a second drawing station 40 and a second transfer assembly 42. The second transfer assembly 14 can be positioned on a robotic arm, movable assembly or other conventional system for moving the titanium pieces formed at the first drawing station 12. The second drawing assembly 40 comprises a second die 44 and a second punch 46 movable along a second linear axis b-b. In certain aspects, the second drawing station 40 further comprises a locking press 48 for engaging the edge portions 36 of the titanium blank 30 to secure the titanium blank 30 to the second die 44. The second die 44 also defines a second recess 50 corresponding to the intermediate or final shape of the formed titanium piece 30. The second transfer assembly 48 is adapted to pick up and position titanium pieces formed in the first drawing station 12 and comprise an engagement element 52 and a lubricant application element 54.

In operation, the engagement element 52 of the second transfer assembly 42 engages the titanium piece 30 drawn at the first drawing station 12 and maneuvers the titanium piece 30 onto the second die 44 such that the formed portion of the titanium piece 30 is positioned within the second recess 50. In certain aspects, the second recess 50 comprises a width corresponding to the width of the first recess 22, wherein the depth d2 of the second recess 50 is greater than the depth d1 of the first recess 22. During positioning or after the titanium piece 30 is positioned on the second die 44, the lubricant application element 54 is operated to apply a second quantity of wet lubricant onto the roughened face 32 of the titanium piece 30 to supplement or replenish the wet lubricant on the roughened face 32. In certain aspects, between about 1.1 and about 2.7 ml per sq. in. of wet lubricant is applied by the second lubricant application element 54. In other aspects, about 1.8 ml per sq. in. of wet lubricant is applied by the second lubricant application element 54. In yet other aspects, the second amount of wet lubricant is about forty percent of the wet lubricant applied by the first lubricant application element 26. After the locking press 48 is closed to engage the edge portion 36 of the titanium piece 30, the second punch 46 is moved along the second linear axis b-b and engages the lubricated roughened face 32. The second punch 46 applies a deforming force along the linear axis b-b against the lubricated roughened face 32 to elongate the wall portion 39 of the titanium piece 30. As depicted in FIGS. 5-6, in certain aspects, formed titanium piece 30 can comprise a horizontal base portion and vertical wall portions corresponding to the dimensions of the first recess 22. The second punch 46 can then be reversed along the linear axis b-b and the formed titanium piece 30 can then be removed.

In certain embodiments, after forming, the formed titanium piece 30 can be washed with a pressurized water system 56 adapted to apply a pressurized water stream against the surfaces of the titanium piece 30 to strip any remaining wet lubricant from titanium piece 30. In certain aspects, the water stream can be applied at a pressure between about 900 and 1100 psi. In other aspects, the water stream can be applied to a pressure of about 1000 psi. The cleaning process can comprise an automated system, wherein at least one robotic arm is used to pick up the titanium piece 30 to position it relative to the pressurized water system 56, and to receive the pressurized water stream and position the titanium strip 30 for cleaning. Alternatively, the pressurized water system 56 can comprise an articulated nozzle 58 mounted on a robotic arm that can be oriented to apply the pressurized water stream to the surfaces of the titanium pieces 30.

In certain embodiments, the system 10 can further comprise a punching die 60 and third punch 62 movable along a third linear axis c-c. The punching die 60 defines a recess 64 for receiving the formed portion 34 of the titanium piece 30, wherein the edge portion 36 rests on the edges of the punching die 60. In operation the third punch 62 is movable along the third linear axis c-c to engage the formed titanium piece 30 and cleave the edge portion 36 from the titanium piece 30.

In certain embodiments, the first punch 18 and second punch 46 can be a hardened metal material allowing punches 18, 46 to engage the titanium blank 30 and apply a deforming force to form the titanium blank 30. The punches 18, 46 can comprise zinc nitrate; carbide with physical vapor deposition of a diamond like coating; or carbide with a chemical vapor deposition coating of a titancote H, titanium nitrate, titanium cyanide, titanium carbide or combinations thereof.

Figure 7:
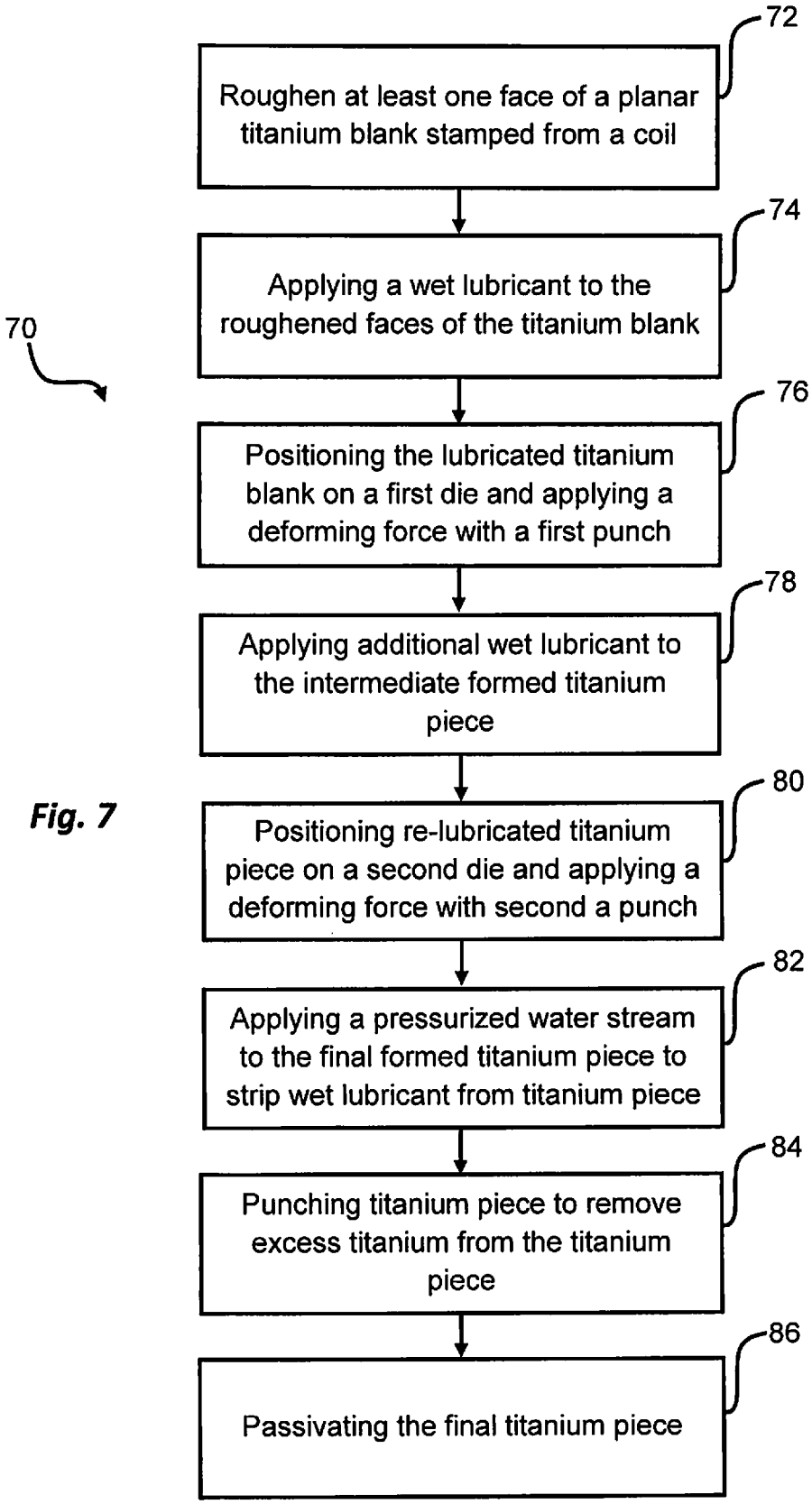
FIG. 7 is a flow chart of a system for forming a titanium piece according to an embodiment of the present invention.

As depicted in FIG. 7, a method 70 for forming titanium pieces from generally planar titanium blanks, according to an embodiment of the present invention, comprises a roughening step 72 in which at least one face 32 of the titanium blank 16 is roughened to a roughness of between about 10 Ra to about 50 Ra. In certain aspects, the roughening step 72 can comprise roughening the at least one face to a roughness of between about 20 Ra to about 40 Ra. The method 60 can also comprise a first lubricating step 74 in which a wet lubricant is applied to the roughened faces 32. In certain aspects, the wet lubricant comprises a graphite component and a mineral spirits component. In various aspects, the graphite component can comprise fifteen to thirty-five weight percent of the lubricant. In other aspects, the graphite component can comprise about twenty-five weight percent of the lubricant. In yet other aspects, the ratio of graphite component to mineral spirits component is 1:3 by weight.

The method 60 further comprises a first drawing step 76 in which the lubricated titanium blank 30 is aligned with the first recess 22 and the first punch 18 is moved along the first linear axis a-a to form the center portion 34 of the titanium blank 30 to conform to the dimensions of the first recess 22. In certain embodiments, the method 30 can further comprise a second lubricating step 78 and a second rolling step 80 to elongate the vertical walls 39 of the deformed portion.

In certain embodiments, the method 70 further comprises a cleaning step 82 in which a pressurized water stream is applied to the opposing surfaces 18*a*, 18*b* to remove any remaining wet lubricant from the opposing surfaces 18*a*, 18*b*. In certain aspects, the pressurized water stream can be applied with a water pressure between about 900 psi and 1100 psi. In other aspects, the pressurized water stream can be applied with a water pressure of about 1000 psi.

In certain embodiments, the method 70 further comprises punching step 84 in which the titanium piece 30 is positioned on the punching die 60 and the third punch 62 is operated to cleave the un-deformed edge portion 36 or excess titanium from the formed portion 34 of the titanium piece 30. In certain embodiments, the punching step 84 can also comprise additional forming steps such as drilling of additional holes or forming of additional portions of the titanium piece 30.

In certain embodiments, the method 70 further comprises a passivation step 86 in which the formed titanium piece 30 is treated with an anti-corrosion coating. In certain aspects, the passivation step 86 can comprise cleaning the base portion 38 and the wall portion 39 with nitric acid before exposing the titanium piece 30 to oxygen to form a titanium oxide layer on the base portion 38 and the wall portion 39.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A method of forming generally planar titanium blanks into formed titanium pieces comprising:

providing a first die assembly comprising a first die defining a first recessed cavity and a first punch movable along a first linear path intersecting the first recessed cavity;

providing a generally planar titanium blank having at least one roughened face;

applying a wet lubricant to the roughened face of the titanium blank;

positioning the titanium blank on the first die such that a portion of the titanium blank is aligned with the first recessed cavity of the first die;

moving the first punch along the first linear path to engage the lubricated roughened face of the titanium blank and deform the aligned portion of the titanium blank into the first recessed cavity of the first die;

providing a second die assembly comprising a second die defining a second recessed cavity and a second punch movable along a second linear path intersecting the second recessed cavity;

applying additional wet lubricant to the roughened face of the formed titanium piece;

positioning the formed titanium piece on the second die such that deformed portion of the titanium blank is received within the second recessed cavity of the second die; and moving the second punch along the second linear path to engage the lubricated roughened face of the titanium blank and elongate the deformed portion of the titanium blank.

2. The method of claim 1, wherein the titanium blank is roughened to a roughness of between 10 Ra to 50 Ra.

3. The method of claim 1, wherein the wet lubricant comprises a graphite component and a mineral oil component.

4. The method of claim 3, wherein the graphite component comprises between fifteen and thirty-five weight percent of the wet lubricant.

5. The method of claim 1, wherein between 3.0 and 6.5 ml per sq in of wet lubricant is applied to the roughened face of titanium blank.

6. The method of claim 1, wherein between 1.1 and 2.7 ml per sq. in. of wet lubricant is applied to the roughened face of titanium piece.

7. The method of claim 1, further comprising:

applying a pressurized water stream to the opposing surfaces of the thinned titanium blank to strip the lubricant from the opposing surfaces.

8. The method of claim 7, wherein the water stream is applied at a water pressure between 900 psi and 1100 psi.

9. The method of claim 1, further comprising:

providing a punching die having a third recessed cavity;

aligning the deformed portion of the titanium pieces with the third recessed cavity; and applying a stamping force with a third punch to remove the portions of the titanium pieces positioned outside the third recessed cavity.

10. The method of claim 1, further comprising applying a passivation process to the titanium blank.

11. A method of a producing a titanium casing having a base portion and at least one wall portion angled relative to the base portion, wherein the base portion and the wall portion having a casing thickness, comprising:

providing a first die assembly comprising a first die defining a first recessed cavity and a first punch movable along a first linear path intersecting the first recessed cavity;

providing a generally planar titanium blank having at least one roughened face;

applying a wet lubricant to the roughened face of the titanium blank;

positioning the titanium blank on the first die such that a portion of the titanium blank is aligned with the first recessed cavity of the first die; and moving the first punch along the first linear path to engage the lubricated roughened face of the titanium blank and press a planar base portion of the titanium blank into first recessed portion and deforming the titanium blank against the first die to form a titanium piece having at least one wall portion angled relative to the base portion;

applying a pressurized water stream to the formed titanium piece to strip the wet lubricant;

providing a second die assembly comprising a second die defining a second recessed cavity and second punch movable along a second linear path intersecting the second recessed cavity;

providing a third die assembly comprising a third die defining a third recessed cavity and third punch movable along a third linear path intersecting the third recessed cavity;

aligning the base portion of the formed titanium piece with the third recessed cavity; and applying a stamping force with the third punch to remove the portions of the titanium piece positioned outside the third recessed cavity.

12. The method of claim 11, wherein the titanium blank is roughened to a roughness of between 10 Ra to 50 Ra.

13. The method of claim 11, wherein the wet lubricant comprises a graphite component and a mineral oil component.

14. The method of claim 13, wherein the graphite component comprises between fifteen and thirty-five weight percent of the wet lubricant.

15. The method of claim 11, wherein between 3.0 and 6.5 ml per sq. in. of wet lubricant is applied to the roughened face of titanium blank.

16. The method of claim 11, further comprising:

positioning the formed titanium piece on the second die such that deformed portion of the titanium blank is received within the second recessed cavity of the second die; and moving the second punch along the second linear path to engage the lubricated roughened face of the titanium blank and elongate the wall portion of the formed titanium piece.

17. The method of claim 16, wherein between 1.1 and 2.7 ml per sq in of wet lubricant is applied to the roughened face of titanium piece.

18. The method of claim 11, wherein the water stream is applied at a water pressure between 900 psi and 1100 psi.

19. The method of claim 11, further comprising applying passivation process to the formed titanium blank.

* * * * *